United States Patent [19]

Oyaba

[11] Patent Number: 4,461,932

[45] Date of Patent: Jul. 24, 1984

[54] RIBBON TYPE SPEAKER AND METHOD OF ASSEMBLING MAGNETIC CIRCUIT THEREOF

[75] Inventor: Takashi Oyaba, Saitama, Japan

[73] Assignee: Pioneer Electronic Corporation, Tokyo, Japan

[21] Appl. No.: 265,495

[22] Filed: May 20, 1981

[30] Foreign Application Priority Data

May 21, 1980 [JP] Japan ..... 55-68742

[51] Int. Cl.[3] ..... H01R 9/00

[52] U.S. Cl. ..... 179/115 V; 179/115 R; 179/181 R; 179/180; 181/166; 181/171; 181/172

[58] Field of Search ..... 179/115 V, 115.5 PV, 179/115.5, ES, 115 R, 180, 181 R; 181/166, 171, 172

[56] References Cited

U.S. PATENT DOCUMENTS 2,147,137 2/1939 Anderson ..... 179/115 V
4,276,452 6/1981 Suyama ..... 179/180

FOREIGN PATENT DOCUMENTS 52-54418 5/1977 Japan ..... 179/115.5 PV
53-12322 2/1978 Japan ..... 179/115 V
53-74418 7/1978 Japan ..... 179/115.5 PV

*Primary Examiner*—Harold I. Pitts
*Assistant Examiner*—Robert Lev
*Attorney, Agent, or Firm*—Sughrue, Mion, Zinn, Macpeak & Seas

[57] ABSTRACT

An improved ribbon-type speaker having an independent magnetic circuit unit and vibration system assembly to thereby reduce second harmonic wave distortion and to provide a speaker which is easy to assemble and disassemble. The case of the magnetic circuit unit can be used as a jig in assembling the magnetic circuit thereby largely reducing the number of steps and the number of tools needed in assembly. The ribbon-type speaker further incorporates advantageously recess portions in a supporting frame of the vibration system assembly together with semicircular cut-out portions provided at both ends of long sides of the opening in the supporting frame. The rigidity of the vibrating plate is thus enhanced and the deformation and elongation of the damper member of the vibration system assembly is reduced.

33 Claims, 24 Drawing Figures

RIBBON TYPE SPEAKER AND METHOD OF ASSEMBLING MAGNETIC CIRCUIT THEREOF

BACKGROUND OF THE INVENTION

The present invention relates to a ribbon-type speaker. More specifically, the invention relates to the structure of a ribbon-type speaker in which a conductive ribbon disposed in a d-c magnetic field produced in the gap of a magnetic circuit is used as a vibrating plate and to a method of assembling to magnetic circuit unit thereof.

Generally, in a ribbon-type speaker, sound waves are generated by passing an audio signal current through a conductive ribbon and by thus vibrating the ribbon in response to the amplitude and the direction of the current. Essential components of the ribbon-type speaker are a magnetic circuit and a vibration system.

A conventional ribbon-type speaker includes, as shown in FIG. 1, a pair of permanent magnets 1*a* and 1*b*, a yoke 2 for magnetically coupling the permanent magnets 1*a* and 1*b*, and a pair of magnetic pole pieces 9*a* and 9*b* mounted adjacent respective ends of the permanent magnets 1*a* and 1*b* in a magnetic circuit. A gap in the magnetic circuit is formed between the pole pieces 9*a* and 9*b*. A conductive ribbon 3, which is supported at both ends by a supporting member 4 mounted on the pole pieces 9*a* and 9*b*, is disposed in the gap of the magnetic circuit. An audio signal current flows from a matching transformer 14 through the ribbon 3 coupled through a band-like feeder 16. The ribbon 3 and the feeder 16 and the related components form a vibration system in the speaker.

In the conventional ribbon-type speaker as described above, the components in the magnetic circuit are integrally assembled with the components in the vibration system. More particularly, the speaker is constructed by assembling the components of the vibrations system in the magnetic circuit. accordingly, such a conventional speaker has a drawback that the light ribbon and the heavy magnetic circuit must be simultaneously handled thus lowering the assembling efficiency.

Also if the permanent magnets of the magnetic circuit are magnetized prior to assembly, their assembly is very difficult.

Another conventional ribbon-type speaker, as shown in FIG. 2, includes a magnet 1, a pair of yokes 2 forming a magnetic circuit together with the magnet 1 with a magnetic air gap G formed between the yokes 2, a ribbon-like vibrating plate 3 arranged in the air gap G, and damper members 6 made of viscoelastic material interposed between the sides of the vibrating plate 3 and the yokes 2.

When assembling such a conventional speaker, specifically, when assembling the vibration system with the magnetic circuit, the vibrating plate 3 is set in the magnetic air gap G of the previously assembled magnetic circuit and the damper member 6 is positioned in the gap between the vibrating plate 3 and the yokes 2. Thus, the extremely thin and deformable vibrating plate 3 must be handled directly which must be done very carefully. This results in a reduction in productivity and an increased cost.

The applicants have previously proposed an improved ribbon-type speaker, as shown in FIGS. 3 to 5, in which it is not necessary to directly handle a vibrating plate 3 when assembling the vibrating plate 3 with the magnetic circuit. The assembly in this case in accomplished by superimposing, as illustrated in FIG. 3, a supporting frame 5 made of aluminum plate or paper or the like in which a rectangular opening 5' is formed having a long side shorter than the length of the ribbon-like vibrating plate 3 and a short side longer than the width of the vibrating plate 3, and a damper member 6 made of viscoelastic film in which an opening 6' is formed having a long side equal in length to the length of the opening 5' and a shorth side shorter than the width of the vibrating plate 3 with the center of the two openings 5' and 6' coinciding with each other. The periphery of the damper member 6 is fusion bonded or adhered with an adhesive to the supporting frame 5. Thereafter, the vibrating plate 3 is placed upon on the damper member 6 so as to block the opening 6' of the damper member 6. The periphery of the opening 6' of the damper member 6 is fusion bonded or adhered with an adhesive to the vibrating plate 3 to thus complete the vibration system assembly. As shown in FIG. 4, the vibrating system assembly is mounted to the yokes 2 to thus arrange the vibrating plate 3 in the air gap G of the magnetic circuit. In FIG. 4, reference numeral 7 indicates sub yokes, which respectively clamp the periphery of the supporting frame 5 through a packing 8 with the stepped portions 2' of the main yokes 2 and secure the vibration system assembly to the magnetic circuit.

With the vibrating plate 3 supported through the film-like damper member 6 by the supporting frame 5 as described above, when the vibrating plate 3 is vibrated, the supporting frame 5 is damped at the corners 5'', as shown in FIG. 5, since the damper member 6 extends higher than the other portions. Accordingly, stress is applied to the vibrating plate 3 resulting in deformation of the vibrating plate 3. Consequently, this stress produces a variation in the stiffness of the vibrating plate 3 in the vibrating direction and thus deteriorates the quality of reproduced sound due to the occurrence of second harmonic wave strain. Further, this stress tends to cause peeling of the vibrating plate 3 from the damper member 6.

SUMMARY OF THE INVENTION

Accordingly, a primary object of the invention is to provide a ribbon-type speaker which can be easily assembled by eliminating the aforementioned disadvantages and drawbacks of the conventional ribbon type speaker.

Another object of this invention is to provide a ribbon-type speaker in which second harmonic wave distortion is reduced in the vibration system assembly thereof so that there is little tendency for the vibrating plate to peel away from the damper member.

Yet another object of the invention is to provide a ribbon-type speaker in which the space needed for the yokes in a case is effectively utilized.

A further object of the invention is to provide a ribbon-type speaker in which the vibration system assembly can be easily replaced, even without demagnetizing the magnet, simply by separating the divided yokes therebetween with a weak force.

Still another object of the invention is to provide a method of assembling a magnetic circuit unit of a ribbon-type speaker in which a jig can be used in the assembly operation in which the number of steps needed in the assembly operation as well the number of tools therefor are greately reduced.

Still another object of the invention is to provide a method of assembling a magnetic circuit unit of a ribbon-type speaker in which the amount of adhesive to be used, the time of drying the adhesive, and the space needed for the adhesive are all reduced. Still another object of the invention is to provide a method of assembling a magnetic circuit unit of a ribbon-type speaker which yields an increased magnetic flux density in the magnetic gap of the magnetic circuit thereof thereby resulting in a reduction in cost and increase in performance of the speaker.

Still another object of the invention is to provide a method of assembling a magnetic circuit unit of a ribbon-type speaker wherein the damping effect of the damper member with respect to the vibrating plate is equalized.

In accordance with these and other objects of the invention, there is provided a ribbon-type speaker including magnetic circuit means and vibration system means. The magnetic circuit means includes a permanent magnet and a pair of yokes disposed adjacent opposite sides of the magnet and including substantially perpendicularly bent portions bent at outer ends thereof forming a magnetic gap therebetween. The vibration system means includes a ribbon-like conductive vibrating plate, a matching transformer, band-like feeder lines for supplying an audio signal current from the transformer to the vibrating plate, and a support for supporting the vibrating plate, the transformer, and the feeder lines. The support has an opening formed therein of a predetermined shape. The magnetic circuit means is connected to the vibration system means by bonding or clamping.

Further, case means is provided having a cavity therein adapted to receive the magnet and the yokes of the magnetic circuit means. The case preferably has a pair of extension walls extending parallel to the yokes of the magnetic circuit and a pair of collars extending from the opposite side walls. The yokes of the magnetic circuit are press-fitted into a gap between the inside walls of the case and the magnet positioned within the case with the end faces of the bent portions being flush with a plane of the opening in the case through which the magnet and the yokes are inserted.

Parallel ribs may be formed integrally with the case extending from the bottom of the cavity up to approximately two-thirds of the height of the magnet to retain in position the yokes once they have been inserted into the cavity. Also, projections may formed integrally with inside walls of the case to hold the yokes in the position longitudinally.

Sound absorbing material and heat absorbing material are provided in the magnetic circuit means with the sound absorbing material being interposed between the bent portions of the yokes and an upper surface of the magnet and slightly compressed therebetween. The supporting frame for the vibrating plate may be interposed as a spacer between the outer end faces of the yokes and sub yokes adjacent thereto with the support magnetically isolating the sub yokes from the main yokes. The magnet may be held in position in the case with adhesive applied to the bottom of the case.

The above and other related objects and features of the invention will be more apparent from the following description and the accompanying drawings.

DESCRIPTION OF THE PREFERRED EMBODIMENTS

Figure 6:
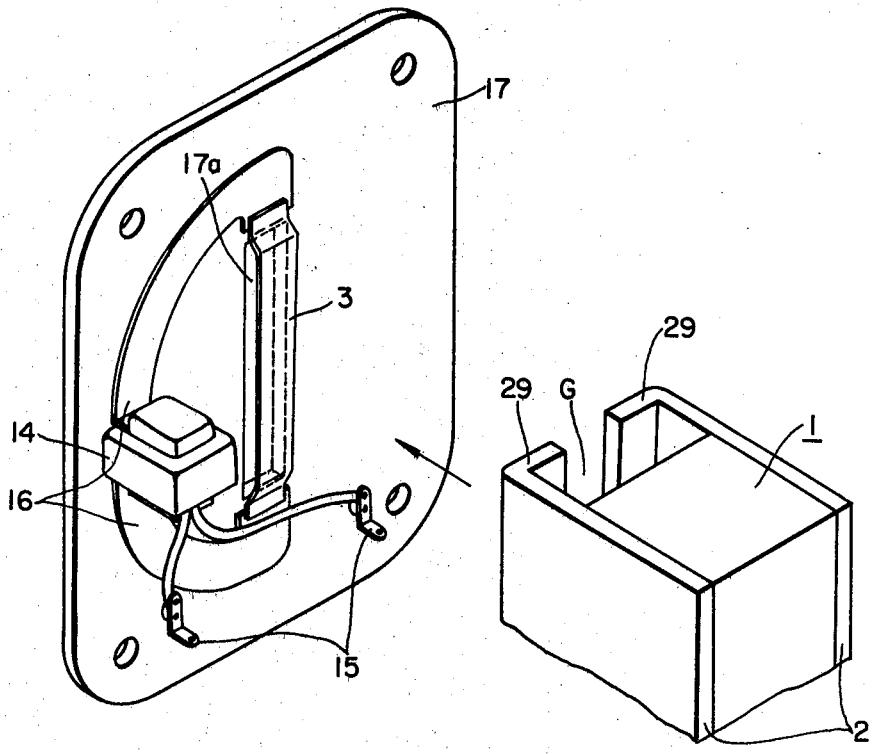
FIG. 6 is an exploded perspective view of a preferred embodiment of a ribbon-type speaker constructed according to the invention.

Reference is now made to the drawings, particularly to FIG. 6, which shows a preferred embodiment of a ribbon type speaker constructed according to this invention, wherein like reference numerals designate the same parts in the following views. The magnetic circuit of the ribbon-type speaker constructed according to this invention includes a permanent magnet 1 and a pair of yokes 2 disposed on opposite sides of the magnet 1. The yokes 2 are bent perpendicularly at their outer ends, designated by reference numerals 2*a*, to form a gap G therebetween.

Further, the vibration system of this embodiment of a ribbon-type speaker of the invention includes a conductive ribbon-like vibrating plate 3 made for example of aluminum foil, a matching transformer 14 having input terminals 15 adapted to be connected to an external circuit, and band-like feeder lines 16 for supplying an audio signal current from the transformer 14. All of these components are mounted on a support 17. The vibrating plate 3 is adhesively mounted at both ends directly to the support 17 confronting an opening 17*a* formed in the support 17. The magnetic circuit is connected with an adhesive or clamped with screws to the support 17 upon which is mounted the vibration system as described above. The magnetic circuit is assembled by moving it in the direction designated by an arrow toward the vibration system in FIG. 6.

Figure 1:
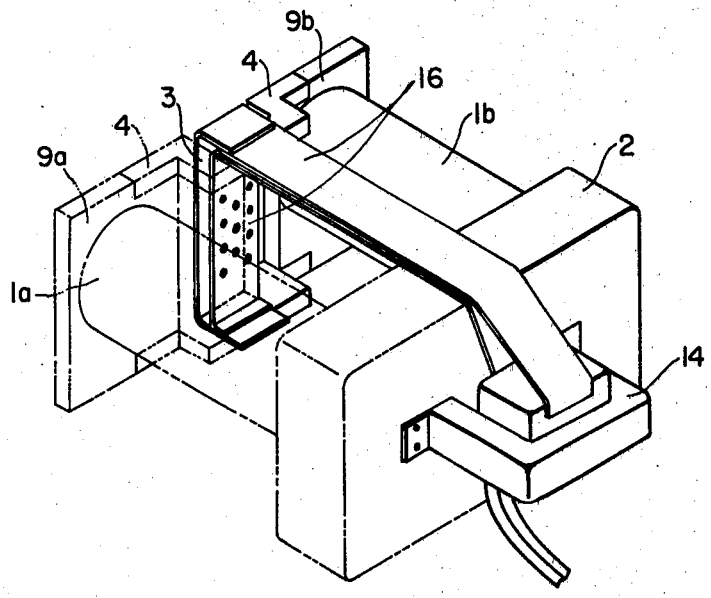
PRIOR ART FIG. 1
FIG. 1 is a perspective view of a conventional ribbon type speaker.
Figure 2:
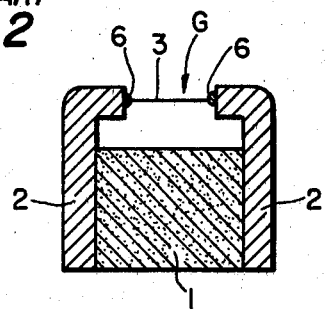
PRIOR ART FIG. 2
FIG. 2 is a cross-sectional view of another example of a conventional ribbon-type speaker.
Figure 3:
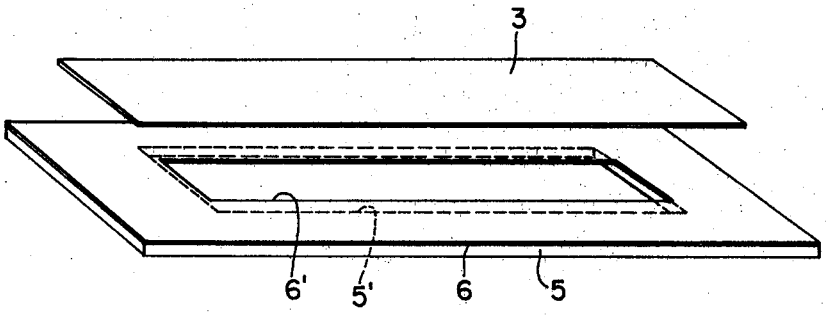
PRIOR ART FIG. 3
FIGS. 3 through 5 are views of various parts the conventional ribbon-type speaker shown in FIG. 2.

In the embodiment shown in FIG. 6, the feeder lines 16 are connected from the transformer 14 directly to both ends of the vibrating plate 3. It is, however, noted that the feeder lines 16 may also be constructed in a folded state as in the conventional speaker shown in FIG. 1. It is also noted that a plurality of vibrating plates 3 may be employed and the permanent magnet 1 in the magnetic circuit may be magnetized before or after the magnetic circuit is connected to the support 17.

Other examples of the magnetic circuit will be described with reference to FIGS. 7 through 9 as the magnetic circuit of the invention is not limited to only the magnetic circuit shown in FIG. 6.

Figure 7:
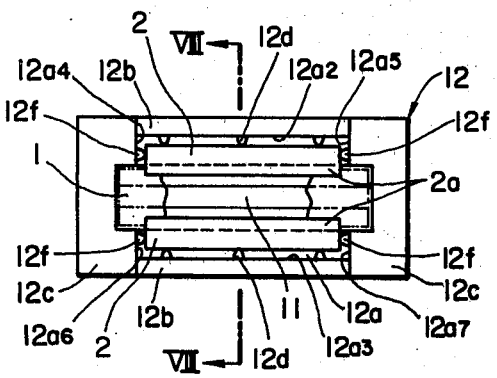
FIG. 7 is a horizontal plan view of the speaker shown in FIG. 6.
Figure 8:
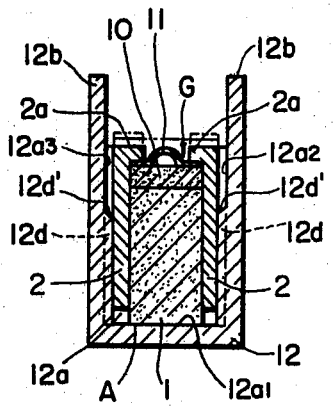
FIG. 8 is a cross-sectional view of the speaker shown in FIG. 6 along a line VIII—VIII in FIG. 7.
Figure 9:
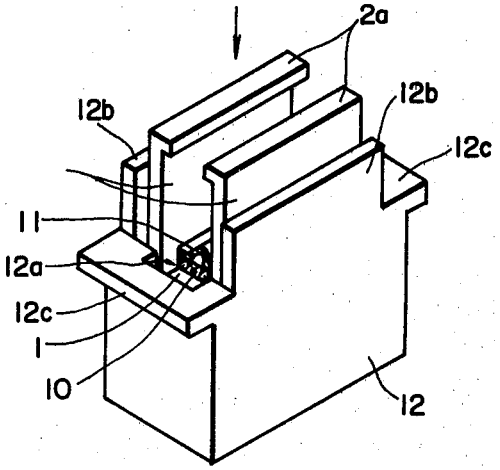
FIG. 9 is a perspective view of a portion of the speaker shown in FIG. 6.

As shown in FIGS. 7 through 9, the magnetic circuit of the ribbon-type speaker of the invention includes a magnet 1, the pair of yokes 2 which are bent perpendicularly at the outer ends 2*a*, and a case 12 having a cavity 12*a* therein for receiving the magnet 1 and the yokes 2. The case 12 may be, for example, integrally formed of resin. The case 12 includes an opening from the cavity 12*a*, a pair of extension walls 12*b* extending along the walls of the case 12 parallel to the yokes 12, a pair of collars 12*c* extending from the walls of the case 12 at the sides other than those where the walls 12*b* are located.

The magnet 1 positioned in the cavity 12*a* in the case 12 is adhesively secured with an adhesive A provided on the bottom $12a_1$ of the cavity 12*a* of the case 12. The yokes 2 are press-fitted into the gap between the inside walls $12a_2$ and $12a_3$ of the cavity 12*a* between the surface of the magnet 1 and the surfaces of the inside walls $12a_2$ and $12a_3$ so as to form a magnetic air gap G therebetween.

The yokes 2 are press-fitted into the gap in such a manner that the outer edges of the end faces of the bent portions 2*a* coincide with the plane of the opening in the case 12 and accordingly the upper surface of the collars 12*c*. This is accomplished by making the height of the yokes 2 less than the depth of the space 12*a* so that the yokes 12 do not make contact at the lower ends with the bottom $12a_1$ of the cavity 12*a* in the case 12.

A plurality of, three in this particular embodiment as exemplified in FIG. 7, ribs 12*d* are integrally formed extending from the bottom $12a_1$ of the cavity 12*a* of the case 12 up to about two-thirds of the height of the magnet 1 toward the inside walls $12a_2$ and $12a_3$ of the case 12 making pressure contact with the surface of the yokes 12 on both sides of the case 12. Further, a projection 12*f*, having the same shape as the ribs 12*d* and formed integrally with the walls projects from the inside walls $12a_4$ and $12a_7$ of the cavity 12*a* of the cars 12 confronting the edge surfaces of the yokes 2 and making pressure contact with the edge surfaces of the yokes 2. The outer end faces of the ribs 12*d* and the projection 12*f* are formed with tapered surfaces 12*d'* and 13*f'*, respectively, which aid in assembling the magnetic circuit, as will be described below in greater detail.

As particularly shown in FIGS. 8 and 9, the magnetic circuit also includes a pad of sound absorbing material 10 and a heat absorbing plate 11. The sound absorbing material 10 is interposed between the bent portions 2*a* of the yokes 2 and the outer surfaces of the magnet 1 and is slightly compressed therebetween. Both the sound absorbing material 10 and the heat absorbing plate 11 have a length and width substantially equal to those of the outer end face of the magnet 1 and are held in position by the inside walls of the yokes 2 together with the magnet 1.

Figure 10:
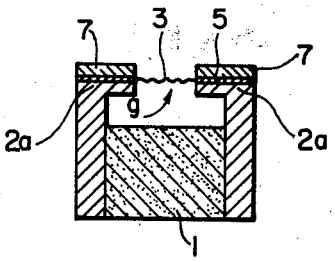
FIG. 10 is a cross-sectional view showing a magnetic circuit of a speaker of the invention.

The mounting position of the vibrating ribbon is not limited to being on the support 17 as shown in FIG. 6 but may also be mounted as shown, for example, in FIG. 10. In FIG. 10, the supporting frame 5 for supporting the vibration ribbon 3 is interposed as a spacer between the main yokes 2*a* and sub yokes 7 so that the main yokes 2 and the sub yokes 7 do not make direct contact with each other.

Accordingly, the main yokes 2 and the sub yokes 7 are spaced apart by the thickness of the supporting frame 5 made of nonmagnetic material such as aluminum, paper or the like. Thus the sub yokes 7 are not secured to the main yokes 2*a* by the magnetic force of magnet. Thus, if the vibrating plate 3 is damaged, because the sub yokes are held only by a weak magnetic force, the vibration system can easily be disassembled from the magnetic circuit and the vibrating plate 3 replaced.

Figure 11:
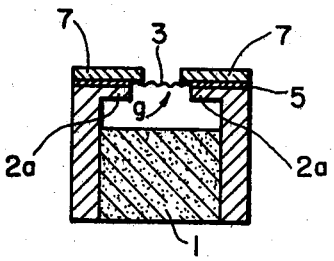
FIG. 11 is a cross-sectional view of a modification of the magnetic circuit shown in FIG. 10.
Figure 12:
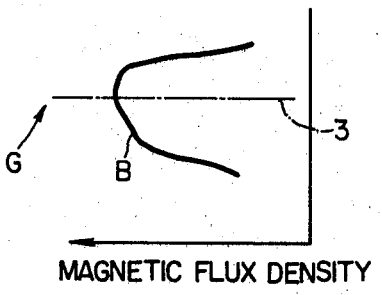
FIG. 12 is a graphic representation of the relationship between the magnetic flux density and the vibrating plate of the embodiment shown in FIG. 11.

Referring now to FIG. 11, there is shown example of a magnetic circuit of the invention. In this embodiment, the distance between the sub yokes 7 is reduced to enhance the efficiency of the magnetic circuit, and the magnetic flux density of the magnetic air gap G is increased corresponding to the reduction in the distance between the sub yokes 7. As further shown by a solid line curve B in FIG. 12, the efficiency of the magnetic circuit may be enhanced by setting the position of maximum flux density in the air gap G coincident with the position of the vibration plate 3.

Figure 4:
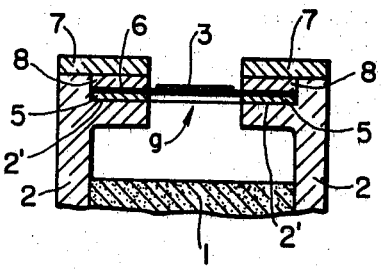
PRIOR ART FIG. 4
Figure 5:
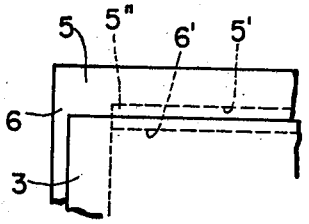
PRIOR ART FIG. 5
Figure 13:
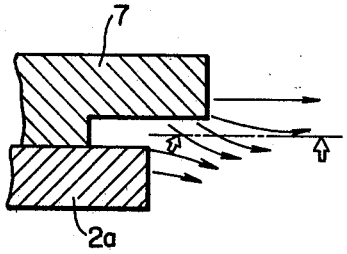
FIG. 13 is a partial cross-sectional view of a sub yoke, used for explanatory purposes.

As also shown in FIG. 13, which shows still another example of a magnetic circuit of this invention, the sub yokes 7 form a part of the magnetic circuit as in the embodiment shown in FIG. 4. In this case, the magnetic field from the sub yokes 7 is excessively strong and the magnetic field in the vicinity of the yokes is curved. Accordingly, the attracting force on the vibrating plate 3 varies as designated by arrows and is different in edge portions than in central portions of the magnetic air gap G. This leads to an abnormal resonance of the vibrating plate 3.

Figure 14:
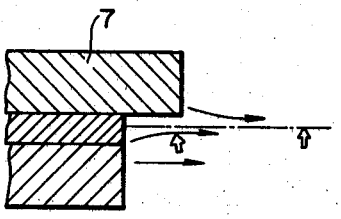
FIG. 14 is a partial cross-sectional view of a further modification of the circuit shown in FIG. 11.

However, in the embodiment as shown in FIG. 11, since the magnetic field formed by the sub yokes 7 is suitably weakened, the direction of the magnetic field is substantially equal over the entire vibrating plate 3 as shown in FIG. 14 so that a speaker having a high performance without any abnormal resonance is realized.

Figure 15:
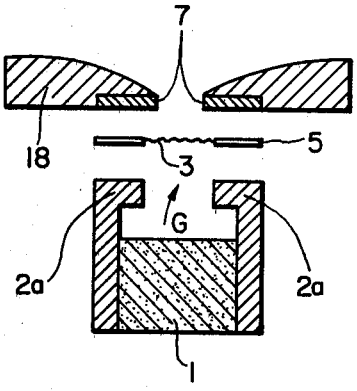
FIG. 15 is a schematic cross-sectional view of a yet further modification of the circuit of FIG. 11.

FIG. 15 shows still another example of a magnetic circuit of the invention. As shown in FIG. 15, the sub yokes 7 are secured to a flange 18 which is constructed to operate also as a horn, for example, outside of the magnetic circuit unit. Thus, since the flange 18 and the magnetic circuit can be temporarily clamped by the magnetic force of the magnet 1 in a state in which the vibration system assembly is interposed therebetween, the ease of assembly is improved.

In this case, it is unnecessary to mount the aforementioned magnetic circuit unit on the support 17 as shown in FIG. 6. Thus, as is designated by broken lines in FIG. 8, the vibration system assembly made of the frame and the ribbon-like vibrating plate can be mounted on the upper end faces of the bent portions 2*a* of the yokes 2 and a horn may be thereafter secured to the extension walls 12*b*.

Since the yokes 2 are press-fitted into the gap between the inside wall of the case 12 and the surface of the magnet 10, the yokes 2 cannot easily be pulled out of the case 12. With the horn mounted as described above, the outer surfaces of the yokes are restricted by the horn. Accordingly, the yokes 2 cannot be pulled out or drop out.

Since there generally may be expected manufacturing variations both of the magnet 1 and in the yokes 2 there are large manufacturing variations in the press-fitting force of the yokes 2. Since the distances between the end surfaces of the yokes 2 are, however, relatively accurate, it is most effective to hold the yokes 2 within the cavity 12*a* by positioning the pressure applying members to abut the end surfaces of the yokes 2.

A preferred embodiment of a method of assembling the magnetic circuit unit constructed as described above will now be described with reference to FIGS. 7 through 9. In accordance with this method, first an adhesive flows into the bottom $12a_1$ of the cavity 12 of the case 12 after which the magnet 1 is inserted into the cavity 12*a* resting against the bottom $12a_1$ of the cavity 12*a*. Then, the pad of sound absorbing material 10 and the heat absorbing plate 11 are positioned on the upper face of the magnet 1 in alignment with the opening in cavity 12*a*. Thereafter, the yokes 2 are inserted between the surface of the magnet 1 and the inside walls $12a_2$ and $12b_3$.

The yokes 2 thus inserted are positioned, as shown in FIG. 9, adjacent the extension walls 12*b* of the case 12 with the upper ends thereof projecting from the opening of the cavity 12*a*. This can easily be done since the ribs 12*d* formed on the inside walls $12a_2$ and $12a_7$ of the cavity 12*a* and the projections 12*f* extend only to about two-thirds of the height of the magnet 1 above which the gaps have a width greater than the thickness of the yokes 2 at the opening side of the cavity 12*a*.

The yokes 2 thus positioned as shown in FIG. 9 are pressurized in the direction indicated by an arrow by a pressing machine. This press fits the yokes 2 into the gaps formed between the surface of the magnet 1 and the inside walls $12a_2$ and $12a_3$ and between the inside walls $12a_4$ and $12a_7$ confronting the surface of the magnet 1 while pressing against the edges of ribs 12*d* and the projections 12*f*. The yokes 2 are press-fitted into the gaps up to the point where the jigs of the pressing machine make contact with the collars 12*c* of the case 12 so that the outer end surfaces of the bent portions 2*a* of the yokes 2 are in the same plane as the plane of the opening in the cavity 12*a*.

If the position of the yokes 2 were to be controlled directly by stepped portions formed on the inside walls of the case, if there is any irregularity in the height of the yokes 2, the bent portions 2*a* of the yokes 2 would not accurately confront each other and the magnetic air gap G would then not be accurately formed. This is an important factor in the operation of speaker. However, an accurate magnetic air gap G is obtained by making the upper end faces of the yokes 2 coincide with the plane of the opening of the cavity in the manner described above.

The adhesive A interposed between the bottom of the magnet 1 and the bottom $12a_1$ of the cavity 12*a* serves to prevent magnet 1 from being dislodged from the bottom $12a_1$ of the cavity 12*a* of the case 12 after the assembly of the magnetic circuit unit has been completed and while the unit is in use. For this use, the adhesive A should be of a type which will not dry until the yokes 2 have been completely press-fitted into the case.

It is noted that in the above-described embodiments, the ribs 12*d* and the projections 12*f* are formed on the inside walls $12a_2$ and $12a_7$ of the cavity 12*a* in the case 12. Variations of this arrangement are possible. For example, projections may also be formed on the yokes 2 or the yokes 2 may be tapered at their lower ends so that the yokes 2 can be press-fitted directly into the gaps formed between the inside walls of the cavity 12*a* and the surfaces of the magnet 1.

As described above, in the magnetic circuit unit described above the yokes are press-fitted into the gaps between the surfaces of the magnet positioned on the bottom of the cavity of the case and the inside walls of the case confronting the surfaces of the magnet. In the magnetic circuit unit used in the ribbon-type speaker of the invention thus constructed and assembled, the case itself may be used as a jig for assemblying the magnetic circuit unit. Moreover, since the magnet and the yokes are sequentially inserted into the cavity of the case to position both the magnet and the yokes therebetween according to the method of assembling the magnetic circuit unit of the invention, the number of the steps used and the tools used in the assembly operation are greatly reduced. Further, it should be appreciated that since the magnet and the yokes are held in place not by bonding therebetween with adhesive but by press-fitting the yokes into the gaps between the magnet and the inside walls of the cavity of the case, the amount of adhesive used, the time needed for the adhesive to harden, and the size of the cavity can be reduced. It is further noted that since adhesive is not interposed between the magnet and the yokes and the magnet is in direct contact with the yokes so that the magnetic flux of the magnet is effectively coupled to the yokes, the magnetic flux density of the magnetic air gap is improved and the cost of the speaker thus fabricated is accordingly reduced yet with an increased performance.

Figure 16:
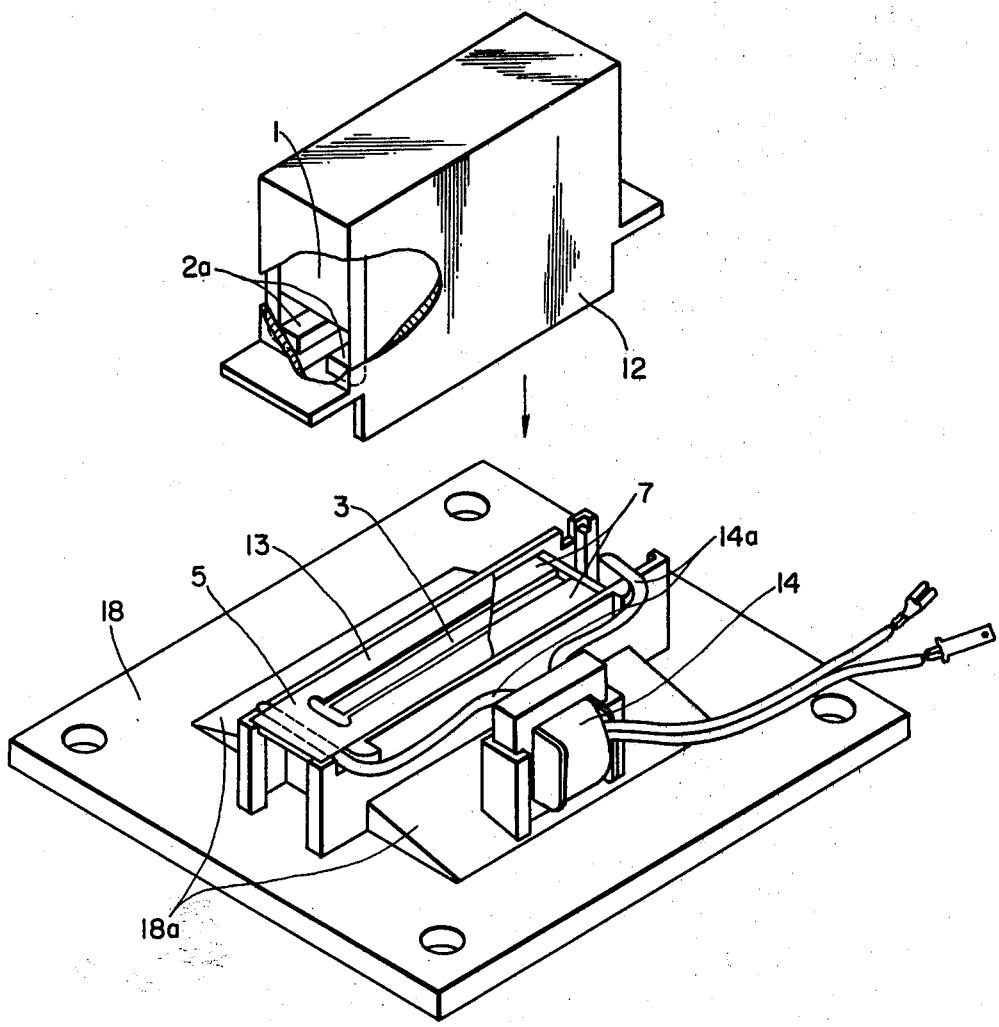
FIG. 16 is an exploded perspective view of still another magnetic circuit of a speker of the invention.

The support 17 of the vibration system assembly shown in FIG. 6 may also be a flange as shown in FIG. 15 operated as a horn as described above. In this case, there is provided, as shown in FIG. 16, a unit in which a horn 18*a*, a flange 18 integrally formed with the horn 18*a*, sub yokes 7 and a matching transformer 14 are mounted on the flange 18. A vibration system assembly 13 includes a vibrating plate 3 and a supporting frame 5 for supporting the vibrating plate 3 through a damper member while a magnetic circuit includes a magnet 1, main yokes 2*a*, sound absorbing material, and heat absorbing material mounted within a case 12. To assemble these components, the vibration system assembly 13 is first positioned with respect to the flange 18 so as to be aligned with the sub yokes 7 as shown in FIG. 16. Then, the magnetic circuit is moved in a direction designated by an arrow toward the vibration system assembly. During this movement, the supporting frame 5 of the vibration system assembly 13 is interposed between the sub yokes 7 and the main yokes 2a and the magnetic circuit is thus correctly positioned with respect to the flange 18.

Since the sub yokes 7 and the main yokes 2a are held together only by a weak magnetic force when the magnetic circuit is temporarily clamped to the flange 18, the ease of integrally mounting the flange with the magnetic circuit using screws or the like clamping the case 12 at the flange 18 thereafter is improved.

The flange 18 thus coupled to the magnetic circuit is placed on its front side, the secondary lead wires 14a from the matching transformer 14 are passed through the opening of the horn to respective ends of the vibrating plate 3 by soldering or the like, at which point the ribbon-type speaker is completely assembled.

It is noted that although in the embodiments described above the vibrating plate is described as being made of a ribbon-like conductive metallic foil such as aluminum foil, beryllium foil or the like, the vibrating plate is not limited to such a construction. For example, the vibrating plate can be made of a spiral coil made of an etched conductive metallic foil on an insulating base film. In this case, a base film may be interposed as a spacer together with a packing between the main yokes and the sub yokes if desired.

It should also be appreciated from the foregoing description that in the ribbon-type speaker of the invention, since a spacer is provided separating the yokes from each other so that the yokes do not directly contact with each other, the yokes can be readily assembled in the magnetic circuit. Moreover, the vibration system assembly can be readly replaced without demagnetizing the magnet by simply separating the divided yokes which are held together only by a weak magnetic force.

Figure 17:
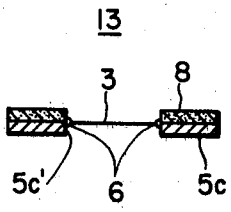
FIG. 17 is a shcematiccross sectional view of the vibration system assembly of the speaker in another preferred embodiment of the invention.

The vibration system assembly is not always be limited to those as exemplified above but may also be constructed as shown in FIG. 17, which shows still another embodiment of a vibration system assembly constructed according to the invention. As seen in FIG. 17, the vibration system assembly includes a frame 5c having an opening 5c', a vibrating plate 3 arranged on the frame 5c so as to longitudinally intersect the opening 5c' of the frame 5c, and a damper member 6 formed of viscoelastic material which couples the longitudinal edges of the vibrating plate 3 to the sides of the frame 5c. In this unit 13 thus constructed, the unit 13 is mounted through a packing 8 to the magnetic circuit in the same manner as the conventional vibration system shown in FIG. 4.

It is noted that the packing 8 may be adhered directly to the frame 5c. However, since the frame 5c is interposed together with the unit between the clamps 7 and the yokes 2 at the stepped portions 2', when mounting the unit, no difficulty occurs even if they are not adhered together.

It is also noted that although in the aforementioned embodiment the clamps 7 are used as sub yokes and form a part of the magnetic circuit, the clamps 7 may also be made of materials other than magnetic materials if desired.

Figure 18:
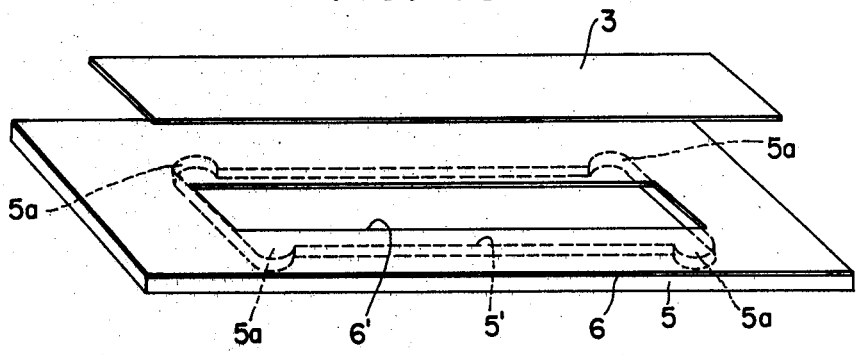
FIG. 18 is an exploded perspective view of the vibration system assembly of the speaker of the invention.

Further, still another example of a vibration system assembly of the invention using a modified supporting frame will be described with reference to FIG. 18. In FIG. 18, the supporting frame 5 has a rectangular opening 5' formed therein including semicircularly cut-out portions 5a at the four corners in the long sides thereof. A vibrating plate 3 is mounted thereon through a damper member 6. As shown in FIG. 18, the distance between the side edges of the vibrating plate 3 and the corresponding edges of the opening 5' is increased at both ends of the long sides of the opening 5' and the length of the damper member 6 interposed therebetween is correspondingly increased. Accordingly, the elongation of the damper member 6 in these portions is quite small when the vibrating plate 3 is vibrated compared with the case where the vibrating plate 3 has no such cut-out portions 5a. Thus, the vibrating plate 3 is damped evenly and undesired stress which is present when no such cutouts 5a are formed at the vibrating plate 5 is suppressed.

Figure 19:
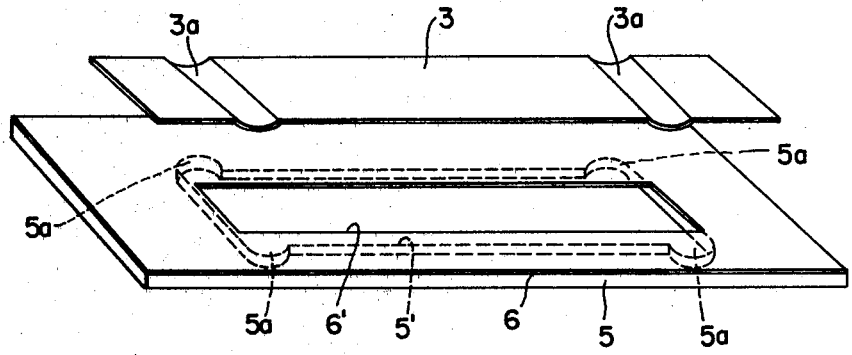
FIG. 19 is a view similar to FIG. 18 but showing another example of the vibration system assembly of the speaker of the invention.
Figure 20:
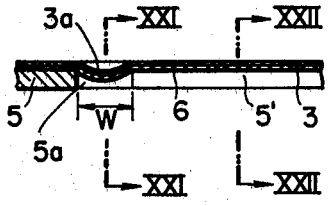
FIG. 20 is an explanatory view of the vibrating system assembly shown in FIG. 19.
Figure 21:
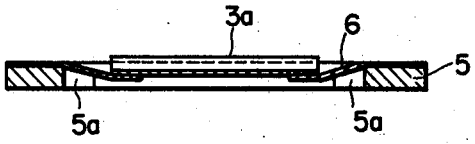
FIG. 21 is a cross-sectional view of the vibration system assembly shown in FIG. 20 taken along a line XXI—XXI.
Figure 22:
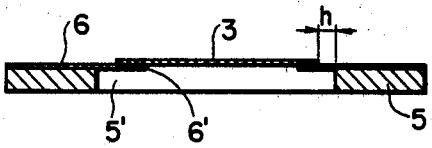
FIG. 22 is a cross-sectional view of the vibration system assembly of FIG. 20 taken along a line XXII—XXII.

In order to enhance the rigidity of a vibrating plate for the ribbon-type speaker made of conductive metallic foil such as aluminum foil or beryllium foil or the like, which typically will have a thickness of approximately 10 μm, indented portions 3a may be, as shown in FIG. 19, be formed in the foil at positions corresponding to the ends of the opening 5' of the supporting frame 5. With such indented portions 3a formed in the vibrating plate 3, deformation and elongation of the portions of the damper member 6 to which the recessed portions 3a are adhered are reduced. Thus, the damper member 6 accordingly reduces the recoil force due to deformation and the elongation thereof. The deformation of the vibrating plate due to the recoil force may be ignored. This may be seen by comparing FIG. 20 showing the vibrating plate of this embodiment with a vibrating plate having no recesses shown in FIGS. 21 and 22 in two different positions.

To compare the vibrating plate of this embodiment with a vibrating plate having no such cut-out portions 5a, the elongation rate λ of the damper 6 was measured under the conditions that the interval h between the vibrating plate 3 and the opening 5' of the supporting frame 5 was, for example set at 1 mm, the width of the indented portions 3a of the vibrating plate 3 was 5 mm, and the depth d thereof was 2 mm. The elongation ratio λ was found to be $\lambda=224\%$ for a damper member having no cut-out portions 5a in the supporting frame 5 while there was measured $\lambda=115\%$ for a damper member which was formed with semicircular cut-out portions 5a having a diameter corresponding to the width w of the indented portions 3a of the vibrating plate 3. Thus, the damper member in this embodiment need bear only one-eighth or less of the recoil force of the damper member if no cut-out portions 5a were provided.

Figure 23:
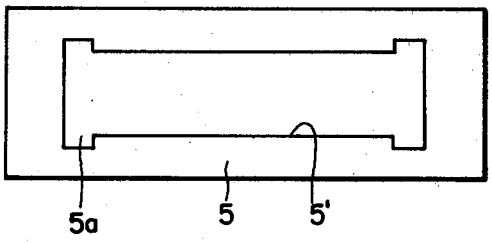
FIG. 23 is a plan view of another example of a supporting frame used in the vibration system assembly of the invention.

It is noted that although in the aforementioned embodiment the cut-out portions 5a formed at both ends of the long sides of the opening 5' of the supporting frame 5 have a semicircular shape, they are not limited to this shape and may, for example, have a rectangular shape as shown in FIG. 23.

Figure 24:
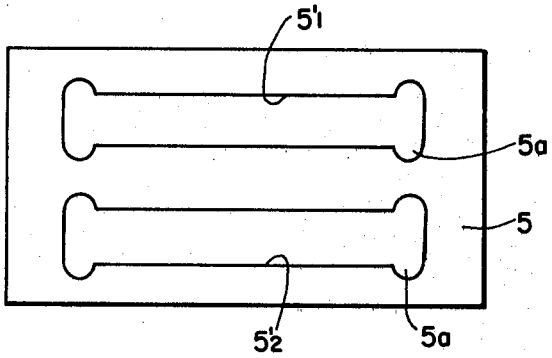
FIG. 24 is a plan view similar to FIG. 23 but showing still another example of a vibrating frame used in the vibration system assembly of the invention.

It is also noted that in case of a ribbon-type speaker having two vibrating plates, two openings $5_1'$ and $5_2'$ may be provided in the supporting frame 5 as shown in FIG. 24, and each long side may be formed with cut-out portions at both ends of the openings $5_1'$ and $5_2'$ in the supporting frame 5.

It is also noted that the opening in the supporting frame 5 is not limited to a rectangular shape as shown and it may also be formed with a substantially elongated rectangular shape extending longitudinally of the vibrating plate 3.

It should be understood from the foregoing description that since the supporting plate of the ribbon-type speaker of the invention which supports through the damper member the vibrating plate is provided with a long rectangular opening with semicircular cut-out portions or the like formed at ends of the long sides of the opening, the damper member provides a uniform damping to the vibrating plate, the deterioration of the quality of sound caused by second harmonic distortion due to irregular stiffness of the vibrating plate is eliminated. Moreover, peeling of the vibrating plate from the damper member upon deformation of the vibrating plate due to irregular damping thereof is also prevented.

What is claimed is:

1. A ribbon-type speaker comprising:

magnetic circuit means comprising a permanent magnet and a pair of yokes disposed adjacent opposite sides of said magnet and having inwardly bent portions forming a magnetic gap therebetween; and vibration system means distinct from said magnetic system means and comprising a ribbon-like conductive vibration plate; a matching transformer; means for supplying an audio signal current from said transformer to said vibrating plate; and support means for supporting said vibrating plate; said transformer, said feeder lines, and said support means having an opening formed therein in a predetermined shape, said magnetic circuit means being secured to said support of said vibration system means.

2. The ribbon-type speaker as claimed in claim 1, further comprising:

case means having a cavity adapted to receive said magnet and said yokes of said magnetic circuit.

3. The ribbon-type speaker as claimed in claim 2, wherein said case means has an opening to said cavity, said case having a first pair of extension walls extending parallel to said yokes of said magnetic circuit means, and a second pair of walls defining said case means having a pair of collars extending therefrom.

4. The ribbon-type speaker as claimed in claim 3, wherein said magnet is secured with an adhesive provided on a bottom of said case means in said cavity.

5. The ribbon-type speaker as claimed in claim 3, wherein said yokes of said magentic circuit means are press-fitted into a gap between inside walls of said case means and surfaces of said magnet and adjacent said surfaces of said case means.

6. The ribbon-type speaker as claimed in claim 3, wherein said yokes of said magnetic circuit means are press-fitted into a gap formed between inside walls of said case means adjacent surfaces of said magnet, and wherein outer end faces of said bent portions are flush with a plane of said opening in said case means and an upper surface of said collars.

7. The ribbon-type speaker as claimed in claim 2, further comprising a plurality of ribs integrally extending from a bottom of said cavity of said case means to approximately two-thirds of the height of said magnet, said ribs protruding from inside walls of said case means to apply pressure contact with adjacent side surfaces of said yokes of said magnetic circuit means, and a plurality of projections formed integrally with inside end walls of said case means at positions to confront end surfaces of said yoke of said magnetic circuit means to apply pressure contact with said end surfaces of said yokes.

8. The ribbon-type speaker as claimed in claim 7, wherein outer end faces of said ribs and said projections are formed with tapered surfaces.

9. The ribbon-type speaker as claimed in claim 7, wherein projections are formed on said yokes of said magnetic circuit means.

10. The ribbon-type speaker as claimed in claim 7, wherein said yokes of said magnetic circuit means are tapered at lower ends so that said yokes are adaptd to be press-fitted directly into gaps formed between inside walls of said case means and adjacent opposed surfaces of said magnet.

11. The ribbon-type speaker as claimed in claim 2, further comprising:

sound absorbing material and heat absorbing material provided in said magnetic circuit means, said sound absorbing material being interposed between said bent portions of said yokes and an upper surface of said magnet under said bent portions and slightly compressed therebetween, wherein both said sound absorbing material and said heat absorbing material have a length and width substantially equal to those of said upper end face of said magnet and are positioned by inside walls of said case means together with said magnet.

12. The ribbon-type speaker as claimed in claim 2, further comprising sub yokes positioned above said yokes, wherein said support means for supporting said vibrating plate is interposed between outer end faces of said yokes and said sub yokes so that said yokes and said sub yokes do not make contact with each other.

13. The ribbon-type speaker as claimed in claim 12, wherein said yokes and said sub yokes are spaced by said support means and wherein said support means is made of nonmagnetic material.

14. The ribbon-type speaker as claimed in claim 13, wherein said nonmagnetic material comprises a material selected from the group consisting of aluminum and paper.

15. The ribbon-type speaker as claimed in claim 12, wherein said magnetic circuit means comprises a flange constructed to operate as a horn and secured to said sub yokes.

16. The ribbon-type speaker as claimed in claim 15, wherein said vibration system means comprises a frame, said vibrating plate being mounted on upper end faces of said bent portions of said yokes of said magnetic circuit means, and a horn secured to said extension walls of said case means.

17. The ribbon-type speaker as claimed in claim 16, wherein said sub yokes ar positioned at end surfaces of said yokes between inside walls of said case means.

18. The ribbon-type speaker as claimed in claim 15, wherein said support comprises a flange functioning also as a horn.

19. A ribbon-type speaker as claimed in claim 1, wherein said bent portions comprise end portions bent perpendicularly to form a magnetic gap therebetween.

20. A ribbon-type speaker as claimed in claim 1, wherein said means for supplying an audio signal current from said transformer to said vibrating plate comprises band-like feeder lines.

21. A ribbon-type speaker comprising:

unit means comprising a horn; a flange formed integrally with said horn; sub yokes and a matching transformer, said sub yokes and said matching transformer being on said flange;

vibration system means comprising a vibrating plate, a damper member and a supporting frame for supporting said vibrating plate through said damper member;

magnetic circuit means comprising a magnet; main yokes; sound absorbing material; heat absorbing material and case means, said sound absorbing material and said heat absorbing material being compressed against said magnet by bent end portions of said yoke, and wherein said magnetic circuit means is mounted on said vibration system means, and said supporting frame of said vibration system means is interposed between said sub yokes of said unit means and said main yokes of said magnetic circuit means positioning said magnetic circuit means with respect to fix the said flange of said unit means.

22. The ribbon-type speaker as claimed in claim 2, wherein said flange of said unit means is flush with said magnetic circuit means at a front side thereof, secondary lead wires of said matching transformer of said unit means being connected through an opening of said horn to corresponding ends of said vibrating plate.

23. The ribbon-type speaker as claimed in claim 21, wherein said vibrating plate is made of an etched spiral coil of conductive metal on an insulating film base, and a film base is interposed as a spacer together with a packing between said main yokes and said sub yokes.

24. The ribbon-type speakr as claimed in claim 21, wherein said supporting frame of said vibration system means comprises a frame having an opening therein, said vibrating plate being arranged on said frame to longitudinally intersect said opening in the frame, and a damper member of viscoelastic material interposed in a gap between said opening of said frame and edges of said vibrating plate for supporting said vibrating plate.

25. The ribbon-type speaker as claimed in claim 22, wherein said packing is coupled integrally to frame and clamped together with said unit between said main yokes and said sub yokes at stepped portions of said sub yokes.

26. The ribbon-type speaker as claimed in claim 23, wherein said sub yokes are positioned to form a part of said magnetic circuit means.

27. The ribbon-type speaker as claimed in claim 23, wherein said sub yokes are made of non-magnetic material.

28. The ribbon-type speaker as claimed in claim 21, wherein said supporting frame of said vibration system means has a rectangular opening formed therein and semi-circular cut-out portions formed at respective ends of long sides of said rectangular opening, said vibrating plate being coupled through a damper member to said supporting frame.

29. The ribbon-type speaker as claimed in claim 28, wherein said supporting frame has a plurality of recessed portions formed therein at predetermined spaced positions corresponding to the length of long sides of said opening.

30. The ribbon-type speaker as claimed in claim 28, wherein said vibrating plate has a plurality of indented portions formed therein at predetermined spaced positions corresponding to the length of long sides of said opening.

31. The ribbon-type speaker as claimed in claim 26, wherein said supporting frame has a rectangular opening formed therein and rectangular cut-out portions formed at respective ends of long sides of said rectangular opening.

32. The ribbon-type speaker as claimed in claim 28, wherein said vibration system means comprises two vibrating plates, each disposed over a corresponding one of two openings formed in said supporting frame of said vibration system means, each of the long sides of said openings in said supporting frame of said vibration system means having cut-out portions at respective ends thereof.

33. The ribbon-type speaker as claimed in claim 32, wherein said opening has a long rectangular shape extending longitudinally of said vibrating plate.

* * * * *